US012467344B2

(12) United States Patent
Al-Anazi et al.

(10) Patent No.: US 12,467,344 B2
(45) Date of Patent: Nov. 11, 2025

(54) GAS LIFT SYSTEM WITH SHEARABLE LIFT GAS VALVES

(71) Applicant: Saudi Arabian Oil Company, Dhahran (SA)

(72) Inventors: Ammal Fannoush Al-Anazi, Dammam (SA); James Ohioma Arukhe, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 30 days.

(21) Appl. No.: 18/370,763

(22) Filed: Sep. 20, 2023

(65) Prior Publication Data

US 2025/0092767 A1 Mar. 20, 2025

(51) Int. Cl.
*E21B 43/12* (2006.01)

(52) U.S. Cl.
CPC ..... *E21B 43/123* (2013.01)

(58) Field of Classification Search
CPC ..... E21B 43/123
See application file for complete search history.

(56) References Cited

U.S. PATENT DOCUMENTS

| | | | | |
|---|---|---|---|---|
| 11,473,402 | B1 | 10/2022 | Faustinelli | |
| 2013/0141100 | A1* | 6/2013 | Labib | G01N 27/82 324/333 |
| 2014/0130893 | A1 | 5/2014 | Harestad et al. | |
| 2015/0148919 | A1* | 5/2015 | Watson | G06N 5/043 700/31 |
| 2020/0032627 | A1* | 1/2020 | Salihbegovic | E21B 47/117 |
| 2022/0364943 | A1 | 11/2022 | Sharma et al. | |
| 2022/0403721 | A1* | 12/2022 | Jaaskelainen | E21B 47/114 |
| 2024/0141762 | A1* | 5/2024 | Vicente Santos | E21B 43/123 |

FOREIGN PATENT DOCUMENTS

CN 104763410 A * 7/2015

OTHER PUBLICATIONS

Al Khatib, Osama et al.; "Intervention-Less Unloading Gas Lift Well Completion Design Using Shearable GLVs and Remote Actuated Barrier Device" (abstract only), SPE-197605-MS, Abu Dhabi Int'l Petroleum Ex. & Conf., Abu Dhabi, Nov. 2019; pp. 1-6.

Naldrett, G et al.; "Production Monitoring Using Next-Generation Distributed Sensing Systems" Petrophysics vol. 59, No. 04. Aug. 2018, pp. 496-510.

* cited by examiner

*Primary Examiner* — Crystal J Lee
(74) *Attorney, Agent, or Firm* — Bracewell LLP; Constance G. Rhebergen; Keith R. Derrington

(57) ABSTRACT

Shearable lift gas valves ("SLG valves") are installed in a well and operate on a contingency basis for injecting lift gas into the well; such as when a lift gas valve that has been in service becomes inoperable or inefficient, or changed well conditions necessitate some form of artificial lift. The SLG valves are maintained in a non-activated configuration with an inner retaining element, and are activated by applying a designated pressure that fractures the retaining element; when activated, the SLG valves operate like other automatic lift gas valves. A SLG valve is installed at a set pressure to replace the inoperable lift gas valve, or at a set pressure that anticipates a change in well conditions, so that when activated, the SLG valve functions at a set pressure different from an in service lift gas valve, and optimizes production from the well with the changed conditions.

15 Claims, 12 Drawing Sheets

GAS LIFT SYSTEM WITH SHEARABLE LIFT GAS VALVES

BACKGROUND OF THE INVENTION

1. Field of Invention

The present disclosure relates to a gas lift system having lift gas valves that become operational by fracturing a frangible member.

2. Description of Prior Art

Production of hydrocarbons that are retained within a subterranean formation typically involves drilling a well that intersects the formation. The well is generally completed by cementing casing inside the well, and deploying production tubing within the casing. A wellhead assembly is mounted at the upper ends of the casing and tubing, and the hydrocarbons are directed to the wellhead assembly through the production tubing. Formation pressures in some wells, even when initially formed, are inadequate to force produced liquids to surface; and over time, many hydrocarbon producing formations experience declines in pressure below that required to produce liquids. Artificial lift is generally employed to produce liquids from wells having inadequate formation pressure. Types of artificial lift include electrical submersible pumps, sucker rod pumping, gas lift, progressive cavity pumps, and plunger lift.

Gas lift systems inject a lift gas from surface into an annulus between the production tubing and casing, or into the production tubing itself. The lift gas lowers the density of liquid inside the well so that existing formation pressure is sufficient to drive the produced fluid to surface. The lift gas is injected into the production tubing from the annulus (or vice versa) through lift gas valves coupled with the production tubing. Most lift gas valves are spring loaded that automatically open and close in response to pressure downhole. Injection pressure operated ("IPO") lift gas valves open and close in response to pressure in the annulus, and production pressure operated ("PPO") lift gas valves open and close in response to pressure in the production tubing. Fluids that are usually in the production tubing are hydrocarbon liquids and gases produced from the surrounding formation. Sometimes these fluids are a result of forming the well or a workover, and have been directed into the production tubing from the annulus. One drawback of automatic spring loaded valves is that the well pressures at which they were designed to operate often change over time, which requires a costly and time consuming replacement of production tubing to return the well to its optimal production.

SUMMARY OF THE INVENTION

Disclosed herein is an example of a method of operating a wellbore which includes lifting liquid from within the wellbore, monitoring an output signal from a distributed fiber optic sensor that is deployed in the wellbore, identifying an anomaly with the step of lifting liquid based on the step of monitoring, and correcting the anomaly. In this example the anomaly is corrected by activating a shearable lift gas valve that is coupled to a production string deployed in the wellbore, and urging lift gas through the shearable lift gas valve into the liquid being lifted from within the wellbore. A conventional lift gas valve is optionally used to inject lift gas into liquid being lifted from within the wellbore prior to the step of identifying the anomaly; in this alternative the anomaly includes a malfunction of the convention lift gas valve or a change in a condition in the wellbore that reduces a rate of liquid being lifted from the wellbore. In an alternative the shearable lift gas valve is included in a string of shearable lift gas valves that is deployed in the wellbore, the method further includes estimating characteristics of an injection of lift gas in the wellbore for correcting the anomaly, the characteristics of the injection of lift gas include parameters such as a lift gas injection depth, a lift gas injection flowrate, and a lift gas injection pressure; and optionally includes identifying a particular one or more of the shearable lift gas valves in the string of shearable lift gas valves to be activated based on the estimated characteristics. The method of this alternative optionally further includes activating and injecting lift gas through the particular one or more of the shearable lift gas valves. In alternatives, the shearable lift gas valves are at different depths, have different set pressures, and different flow rate capacities. The step of identifying can be based on monitoring the output signal from the distributed fiber optic sensor. Prior to being installed in the wellbore, depths, set pressures, and flow rate capacities of the shearable lift gas valves are optionally designated based on a forecast of future conditions in the wellbore. In an example in which the anomaly is a reduction of pressure in the wellbore, prior to identifying the anomaly, the liquid is being lifted from within the wellbore by pressure in the wellbore. In embodiments, the liquid being lifted from the wellbore is production fluid that has flowed into the wellbore from a formation surrounding the wellbore, or optionally the liquid being lifted from the wellbore is completion fluid that is being unloaded from the wellbore.

Another example method of operating a wellbore is disclosed, which includes monitoring an output signal from a distributed fiber optic sensor that is deployed in the wellbore, identifying a designated lift gas injection into the wellbore based on the step of monitoring, activating a shearable lift gas valve that is coupled to a production string deployed in the wellbore, and injecting lift gas through the shearable lift gas valve into liquid being lifted from the wellbore. In this example the designated lift gas injection maximizes a rate at which the liquid is being lifted from the wellbore. Optionally, prior to activating the shearable lift gas valve, the liquid was lifted from the wellbore by pressure in the wellbore. In an example, prior to activating the shearable lift gas valve, the liquid was lifted from the wellbore by an injection of lift gas through a conventional lift gas valve. In one embodiment in which the shearable lift gas valve is a first shearable lift gas valve and where a second shearable lift gas valve is coupled to the production string, the method further includes comparing a first flow rate of liquid being lifted from the wellbore by injecting lift gas through the first shearable lift gas valve to a second flow rate of liquid being lifted from the wellbore by injecting lift gas through the second shearable lift gas valve; and that optionally further includes activating the first shearable lift gas valve if the first flow rate exceeds the second flow rate and activating the second shearable lift gas valve if the second flow rate exceeds the first flow rate, and injecting lift gas through the first shearable lift gas valve after activating the first shearable lift gas valve, and injecting lift gas through the second shearable lift gas valve after activating the second shearable lift gas valve. In an alternative in which the shearable lift gas valve is one of a plurality of shearable lift gas valves that are coupled to the production string, the method further includes maximizing a rate of the liquid being lifted from the wellbore by activating a designated one of the plurality of shearable lift gas valves and injecting lift gas through the designated one of the plurality of shearable lift gas valves.

Yet another example method of operating a wellbore is disclosed that includes monitoring an output signal from a distributed fiber optic sensor that is deployed in the wellbore, and based on the step of monitoring, estimating a designated lift gas injection from a string of shearable lift gas valves for lifting liquid from the wellbore, activating less than all of the shearable lift gas valves, and injecting lift gas through the activated shearable lift gas valves and into the liquid.

BRIEF DESCRIPTION OF DRAWINGS

Some of the features and benefits of the present invention having been stated, others will become apparent as the description proceeds when taken in conjunction with the accompanying drawings, in which.

Figure 1:
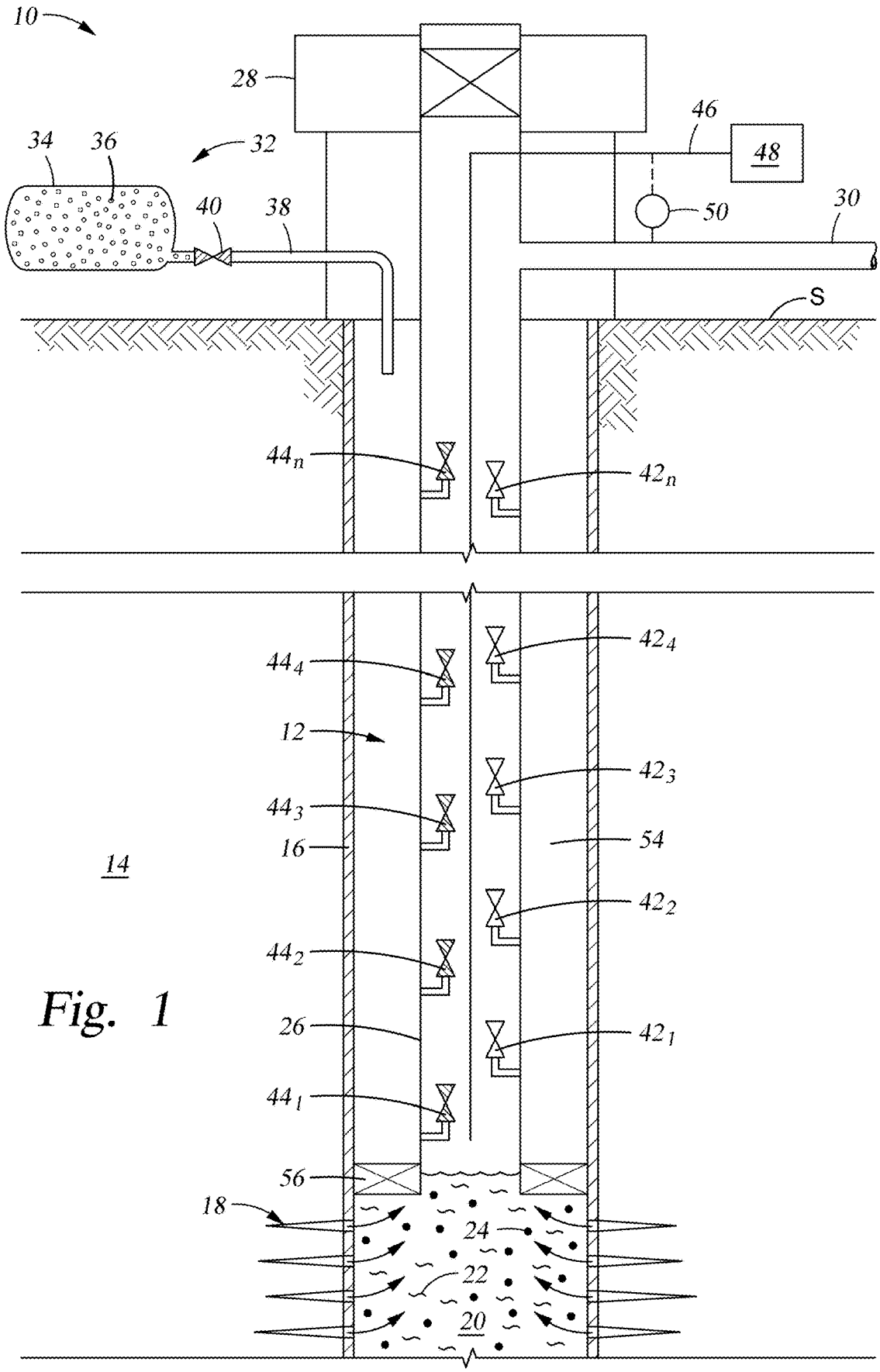
FIG. 1 is a side partial sectional view of an example of a gas lift system having shearable lift gas valves installed in a well.

While subject matter is described in connection with embodiments disclosed herein, it will be understood that the scope of the present disclosure is not limited to any particular embodiment. On the contrary, it is intended to cover all alternatives, modifications, and equivalents thereof.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of a cited magnitude. In an embodiment, the term "substantially" includes +/−5% of a cited magnitude, comparison, or description. In an embodiment, usage of the term "generally" includes +/−10% of a cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Shown in a side sectional view in FIG. 1 is an example of a well system 10 that includes a wellbore 12 drilled into a subterranean formation 14. Hydrocarbons within the formation 14 are produced with the well system 10. An annular casing 16 is cemented to sidewalls of the wellbore 12, perforations 18 project radially outward from within the wellbore 12 through the casing 16 and a distance into the formation 14. A produced fluid 20 is illustrated flowing from the formation 14 into the bottom of the wellbore 12 through the perforations 18. In examples, produced fluid 20 is made up substantially of liquid 22, which in alternatives includes hydrocarbon, water, or a mixture of both; produced fluid 20 optionally includes a combination of liquid 22 and gas 24. A string of production tubing 26 is inserted into the wellbore 12 to provide a conduit of the produced fluid 20 to surface S and into a wellhead assembly 28 shown mounted over an opening of the wellbore 12. A production line 30 is shown extending laterally from the wellhead assembly 28, and as described in more detail below carries produced fluid to an offsite facility for transportation and/or processing.

Included with the well system 10 is a gas lift system 32 that includes a lift gas source 34, which provides lift gas 36 to the wellbore 12. A lift gas injection line 38 has one end connected to the lift gas source 34 and at opposite disposed within the wellbore 12 below the wellhead assembly 28. A lift gas control valve 40 is in the lift gas line 38, which is shown in a closed configuration that blocks lift gas 36 from flowing through the line 38 into wellbore 12. Examples of the lift gas source 34 include a pressurized vessel, a transmission line, an adjoining well, or combinations. Coupled at different elevations along the production tubing 26 are lift gas valves $\mathbf{42}_{1\text{-}n}$. For the purposes of discussion herein, the lift gas valves $\mathbf{42}_{1\text{-}n}$ are referred to as conventional lift gas valves, which in examples include IPO type valves, PPO valves, and combinations of these types of valves. As explained in more detail below, the IPO and PPO valves are spring-loaded valves and that operate in response to pressure surrounding valves. Shearable lift gas valves $\mathbf{44}_{1\text{-}n}$ are included with the gas lift system 32, which in the example of FIG. 1 are in a nonactivated state and not in a configuration to allow for a flow of lift gas 36 therethrough. A retaining element is included with each of the shearable lift gas valves $\mathbf{44}_{1\text{-}n}$ to retain them in the nonactivated state, when in the nonactivated state the shearable lift gas valves $\mathbf{44}_{1\text{-}n}$ are in a closed configuration, which blocks communication through the valves $\mathbf{44}_{1\text{-}n}$. The retaining element is frangible, and when a one of the valves $\mathbf{44}_{1\text{-}n}$, is subjected to an activation pressure, its associated retaining element is fractured. Fracturing a retaining element in one of the valves $\mathbf{44}_{1\text{-}n}$ changes the status of the one of the valves $\mathbf{44}_{1\text{-}n}$ from a nonactivated state to an activated state. When in the activated state the one of the valves $\mathbf{44}_{1\text{-}n}$ operates the same or substantially the same as lift gas valves $\mathbf{42}_{1\text{-}n}$. An example of a shearable lift gas valve is found in Salihbeglbic, et al., U.S. Pat. No. 10,787,889, which is incorporated by reference herein in its entirety and for all purposes.

Still referring to FIG. 1, a distributed fiberoptic sensor line 46 is inserted within the production tubing 26, and which is available from Yokogawa Corporation Of America, 12530 West Airport Blvd, Sugar Land, Texas 77478, USA. In the example shown, sensor line 46 is a continuous member that extends substantially the entire length of the production tubing 26 and has an upper end outside of wellhead assembly 28 on surface. A controller 48 is schematically shown and in signal communication with the distributed fiberoptic sensor line 46 and that selectively receives signals from the sensor line 46. In examples, signals the represent measured values of temperature and/or pressure within the wellbore 12 and the corresponding depth at which those temperatures and pressures in the wellbore 12 are being sensed by the sensor line 46. An optional sensor 50 is shown mounted onto production line 30 and which is schematically shown in signal communication with sensor line 46 and/or controller 48.

Figure 2A:
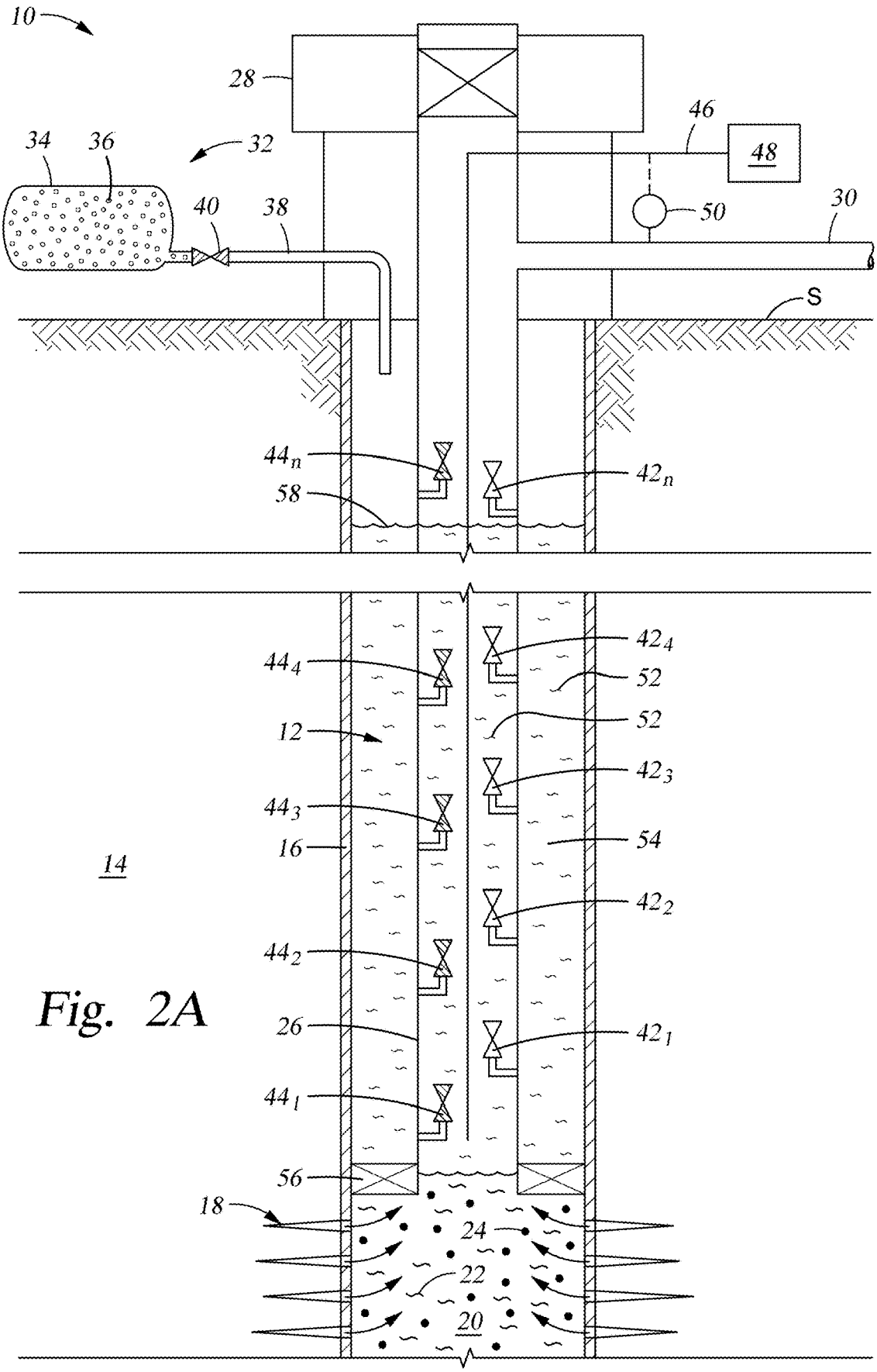
FIGS. 2A-2F are side sectional views of an example of an unloading process with the gas lift system of FIG. 1.

Referring now to FIGS. 2A through 2F, shown in a side sectional view is an example of using the valves $\mathbf{42}_{1\text{-}n}$, $\mathbf{44}_{1\text{-}n}$ for unloading liquid from the wellbore 12. In FIG. 2A, a completion fluid 52 is in the production tubing 26 and in an annulus 54 between production tubing 26 and casing 16. For the purposes of discussion herein, produced fluid 20 and completion fluid that are in the wellbore 12 are each optionally referred to as well fluid. Further in the example of FIG. 2A, when the production string with attached valves $\mathbf{42}_{1\text{-}n}$, $\mathbf{44}_{1\text{-}n}$, is initially installed within the wellbore 12, the lift gas valves $\mathbf{42}_{1\text{-}n}$ are in an open configuration, and the shearable lift gas valves $\mathbf{44}_{1\text{-}n}$, are in a nonactivated and closed configuration. In an example of operation, each of the valves $\mathbf{42}_{1\text{-}n}$ remain open when exposed to pressures ranging from 0 psig to a first set pressure that is greater than 0 psig, close when pressure reaches a second set pressure that is greater than the first set pressure, and remain closed until further pressure increases reach a third set pressure that is greater than the second set pressure, the valves $\mathbf{42}_{1\text{-}n}$ reopen at the third set pressure and remain in the re-opened state at pressures between the third set pressure and a fourth set pressure that is greater than the third set pressure, and reclose when pressure reaches a fourth set pressure and remain closed at pressures above the fourth set pressure. Further in this example, the third and fourth set pressures are different for each of the valves $\mathbf{42}_{1\text{-}n}$, so that a pressure range at which one of the valves $\mathbf{42}_{1\text{-}n}$ is in the reopen configuration (e.g., between the third and fourth set pressures), which is referred to as the reopen pressure range, is different from a reopen pressure range of the other valves $\mathbf{42}_{1\text{-}n}$. Optionally, valves $\mathbf{42}_{1\text{-}n}$ that are disposed adjacent one another have reopen pressure ranges that are also adjacent, e.g., the fourth set pressure of valve $\mathbf{42}_3$ is approximately equal to the third set pressure of valve 422.

A packer 56 is shown circumscribing a lower end of production tubing 26 and that defines a barrier to fluid communication between the annulus 54 and the lower end of the production tubing 26. The lift gas valves $\mathbf{42}_{1\text{-}n}$ when initially installed are in the open configuration and when pressure in the wellbore 12 is between the first and second pressures, which allows free flow of the completion fluid 52 between the annulus 54 and inside of the production tubing 26 through the lift gas valves $\mathbf{42}_{1\text{-}n}$, so that a liquid level 58 of completion fluid 52 in the annulus 54 is the same as in the production tubing 26.

Figure 2B:
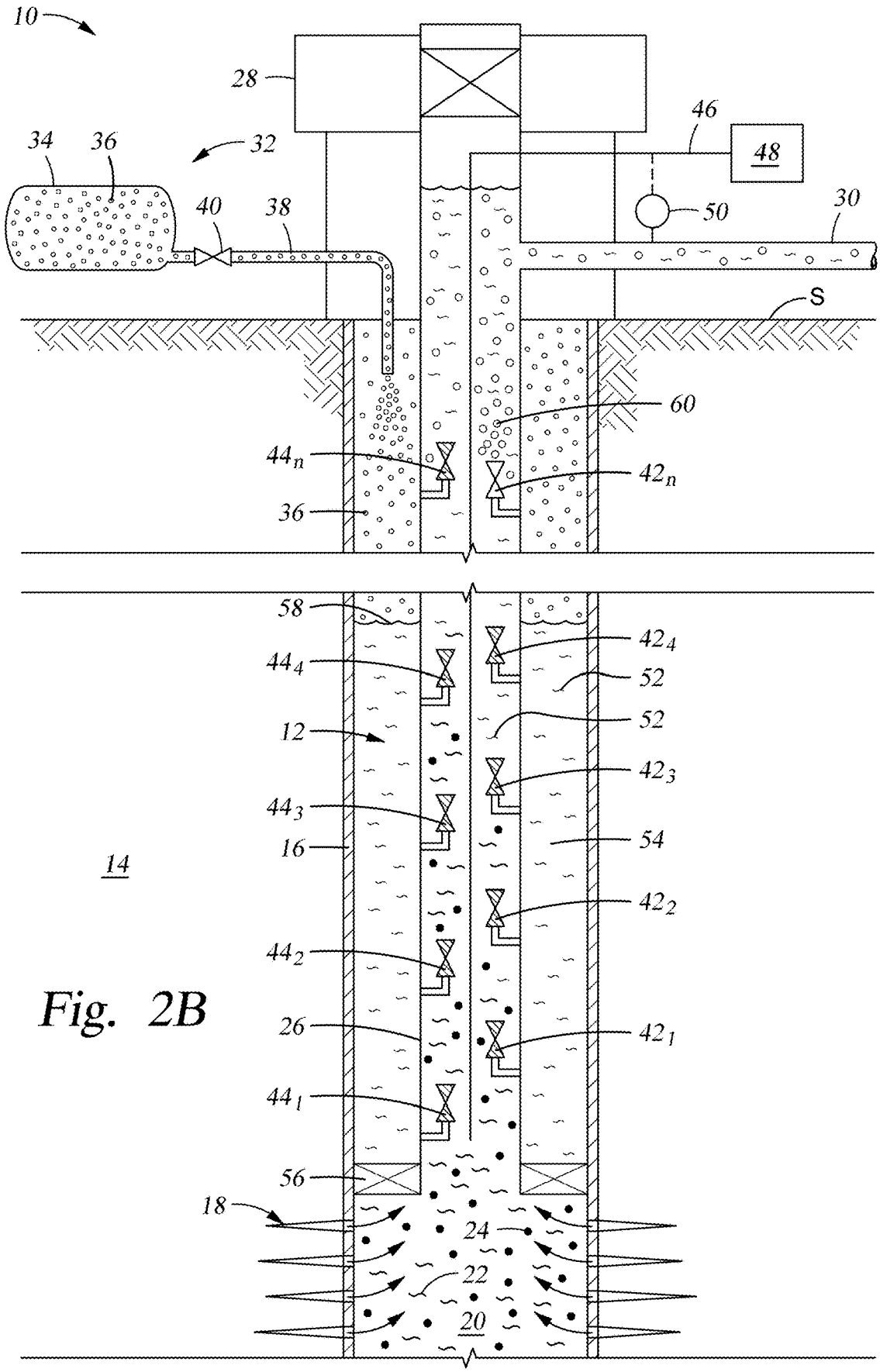

Referring now to FIG. 2B, unloading the wellbore 12 includes opening the gas control valve 40 to allow lift gas 36 to flow through the lift gas line 38 and into the annulus 54. The flow of the lift gas 38 increases the pressure in the annulus 54 to above the second set pressure for each of the lift gas valves $\mathbf{42}_{1\text{-}n}$ putting each into a closed configuration. Lift gas 36 continues to flow into and increase pressure in the annulus 54 until reaching the third set pressure of uppermost lift gas valve 42*n*, which causes the lift gas valve 42*n* to reopen and allow lift gas 36 from the annulus and into the production tubing 26, and which is shown forming bubbles 60 of lift gas within the well fluid 52 inside the production tubing 26. A continued injection of lift gas 36 into the annulus 54 further raises pressure in the annulus 54 to the fourth set pressure of the lift gas valve 42*n* and causing it to reclose. As noted above, reopen pressure ranges of the lift gas valves $\mathbf{42}_{1\text{-}n}$ increases with depth, so that continued increases in pressure by the introduction of more lift gas 36 then over time causes a next lower lift gas valve $\mathbf{42}_{1\text{-}n}$ to move into a reopen configuration and release lift gas 36 into the production tubing 26 and so on. Additionally, the reopening and reclosing pressure ranges for the lift gas valve $\mathbf{42}_{1\text{-}n}$ are set to avoid multi-pointing, in which multiple valves are simultaneously discharging lift gas 36 into production tubing.

Figure 2C:
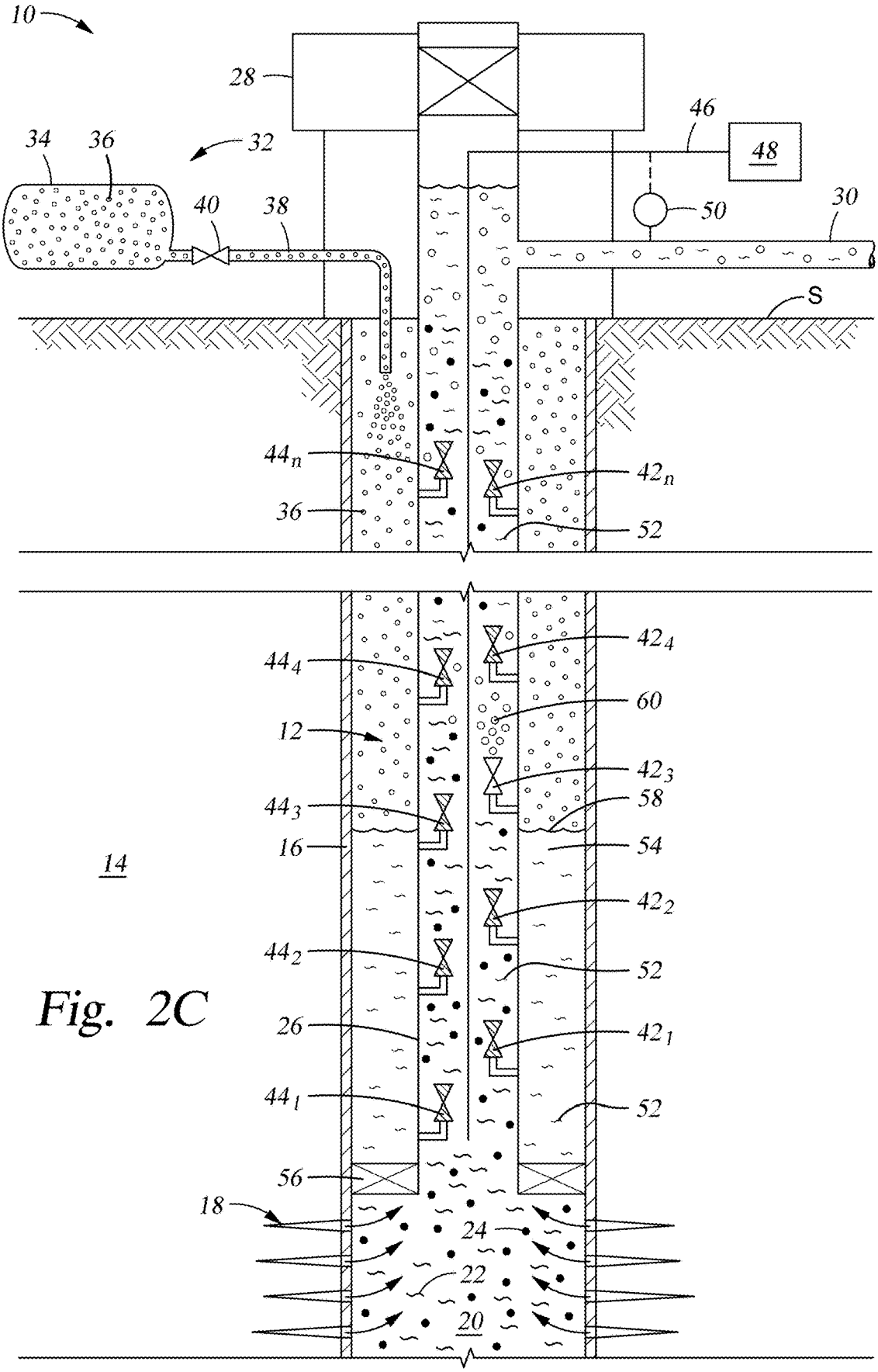

As shown in the example of FIG. 2C, the liquid level 58 has dropped to a depth below that of lift gas valve $\mathbf{42}_3$, which is shown in the reopen configuration and generating bubbles 60 of lift gas 36 within the liquid column of completion fluid 52 inside production tubing 26. Additionally, the valves $\mathbf{42}_{4\text{-}n}$ are shown in a closed configuration as the pressure within annulus 54 has exceeded their upper thresholds of reopen configurations (the fourth set pressure). Additionally, lift gas valves $\mathbf{42}_{1,2}$, which are at greater depths than lift gas valve $\mathbf{42}_3$, are set with a reopening pressure which is greater than the closing threshold pressure for lift gas valve $\mathbf{42}_3$ and will remain in a closed configuration while lift gas valve $\mathbf{42}_3$ is the open configuration of FIG. 2C. Eventually, as shown in FIG. 2E, the lowermost lift gas valve $\mathbf{42}_1$ is shown in the reopen configuration and where the liquid level 58 is towards a lower end of the wellbore 12. As such, the completion fluid 52 has been substantially unloaded from the wellbore 12.

Figure 2D:
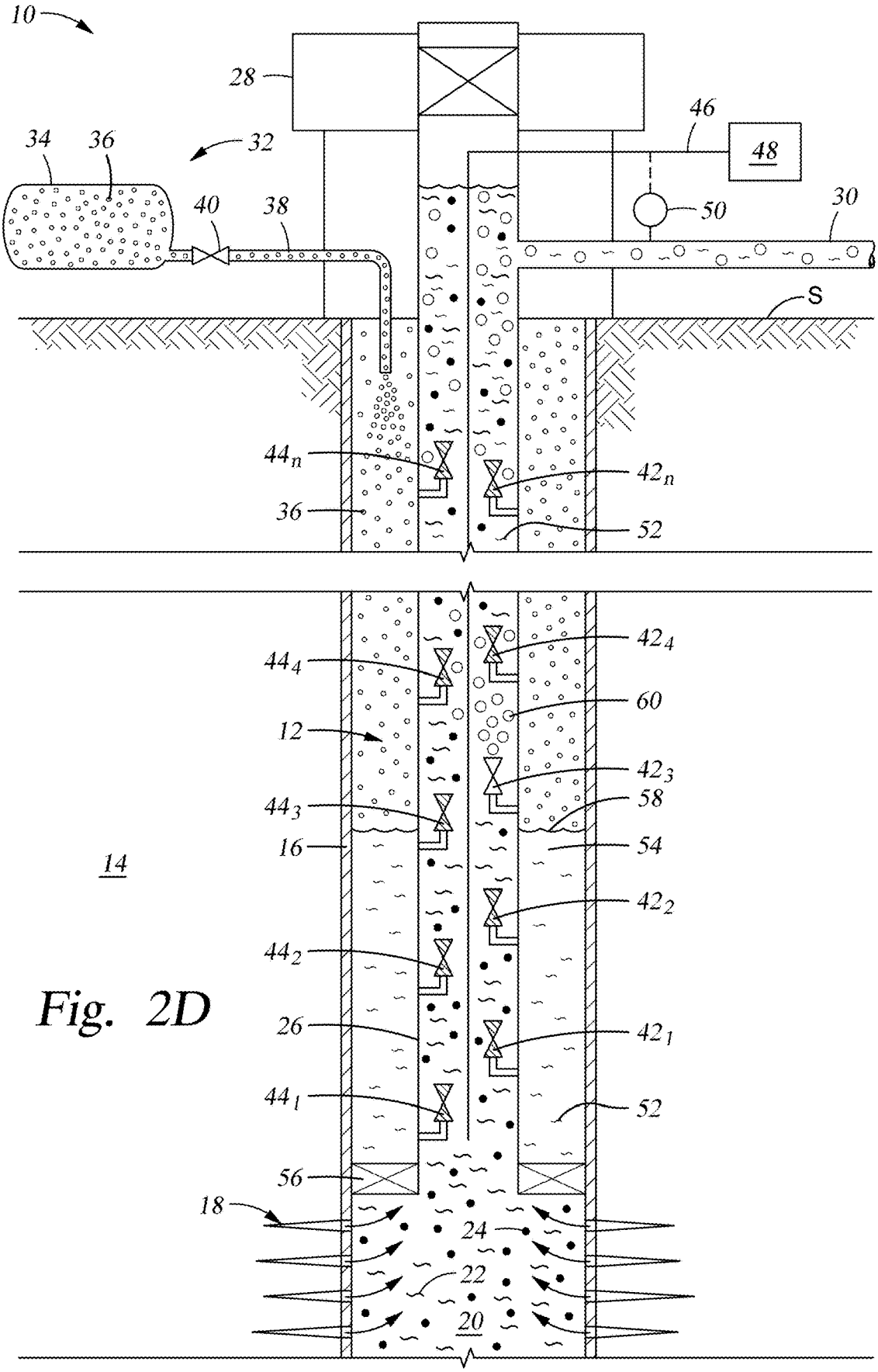
Figure 2E:
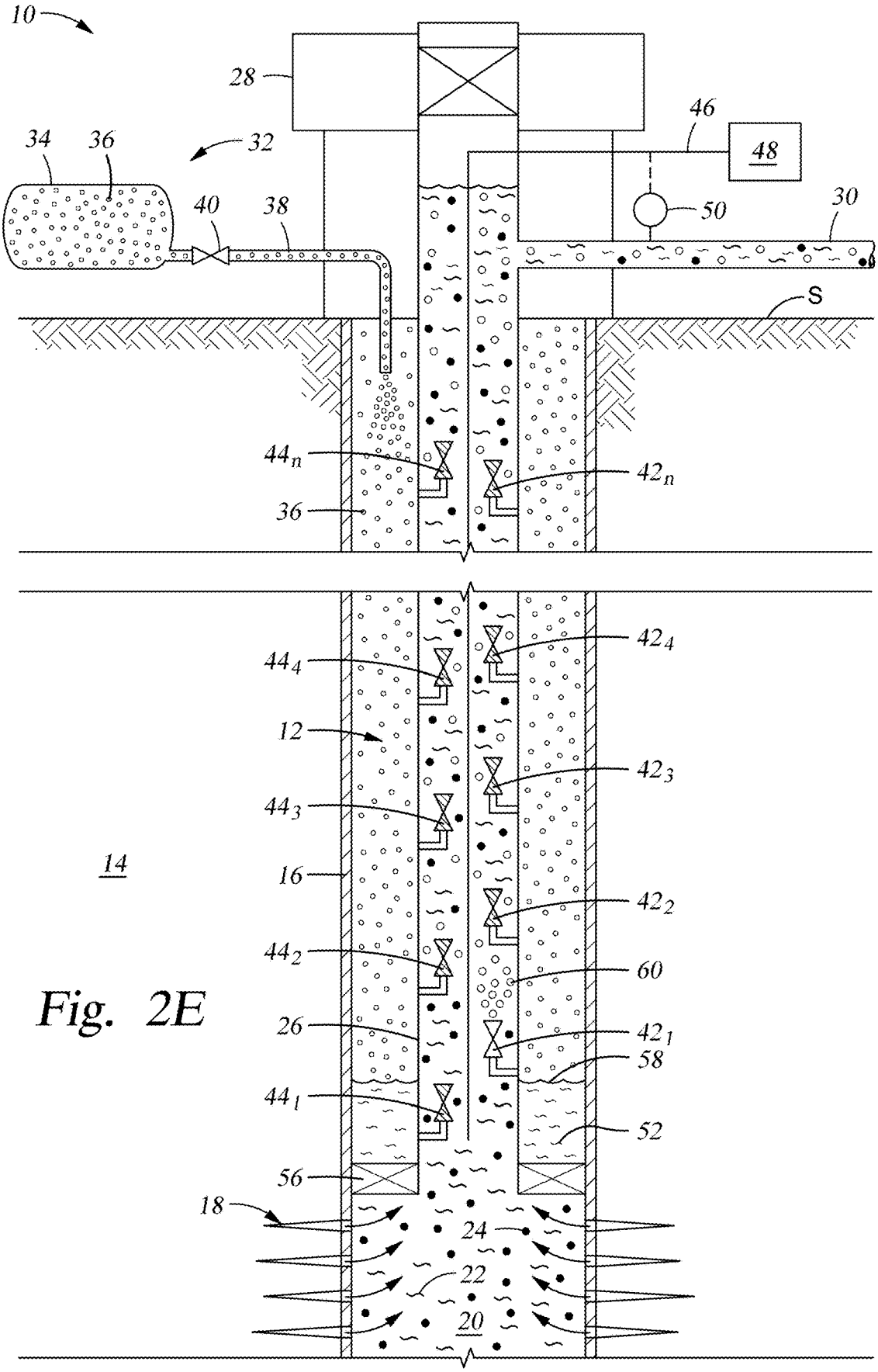

Referring now to FIG. 2D, an example of an anomaly in valve $\mathbf{42}_3$ is shown in which the pressure within annulus 54 is within the range at which the lift gas valve $\mathbf{42}_3$ is designed to be in the reopen configuration (between the third and fourth set pressures) but due to blockage or mechanical failure the lift gas valve $\mathbf{42}_3$ is instead in a closed configuration and which does not allow an injection of lift gas 36 into the production tubing 26. Alternatively, an anomaly is caused by a pressure drop in the formation 14 due to hydrocarbon extraction, which lowers pressure in the production tubing 26 below a level so that inefficient lift results by injecting lift gas 36 at the reopen pressure range of lift gas valve $\mathbf{42}_3$. Not to be bound by theory, but injecting lift gas 36 at too great a pressure difference above a pressure in the production tubing 26 creates very large bubbles 60 of lift gas 36, which reduces the volume of the produced fluid 20 and/or liquid 22 being lifted to surface S.

A non-exhaustive list of anomalies includes mechanical failures, which as mentioned above, a valve might not open due to blockage or mechanical failure, even when the pressure conditions should allow it to. Pressure anomalies include sudden spikes or drops in annulus or tubing pressure could occur that are not associated with normal operations, and pressure readings that are consistently different from expected values based on the depth and fluid column. Temperature anomalies include unusual temperature readings from the distributed fiberoptic sensor line could indicate issues. For instance, an unexpected rise in temperature might suggest a leak or rupture, while an unexpected drop might indicate blockage or fluid ingress. Gas bubble size anomalies, which as noted, injecting lift gas at too great a pressure difference can create very large gas bubbles, reducing the efficiency of the lift. Conversely, too small bubbles might indicate insufficient gas injection or a valve not opening fully. Flow rate anomalies, in which a sudden decrease in the flow rate of produced fluids, or a flow rate that doesn't match the expected rate based on the gas injection rate and pressure readings. Composition anomalies, which include changes in the composition of the produced fluids, such as an unexpected increase in water content or a decrease in hydrocarbon content, could indicate issues with the reservoir or the gas lift system. Sensor failures can create inconsistent or erratic readings from sensors, or a complete lack of data from a particular depth, could indicate a sensor failure or a problem with the communication system. Operational anomalies could be due to shearable lift gas valves not transitioning from a nonactivated state to an activated state even when subjected to the expected activation pressure. External interference or damage, signs of which could be from drilling operations in nearby wells or geological events like earthquakes, could affect the operation of the gas lift system. Acoustic anomalies, which manifest as unusual noises or vibrations detected by sensors could indicate mechanical issues or flow irregularities. Actual conditions constituting an anomaly often depend on the specific design and operational parameters of the gas lift system, as well as the characteristics of the well and reservoir. Regular monitoring, maintenance, and system checks are implemented to detect and address these anomalies promptly.

Figure 2F:
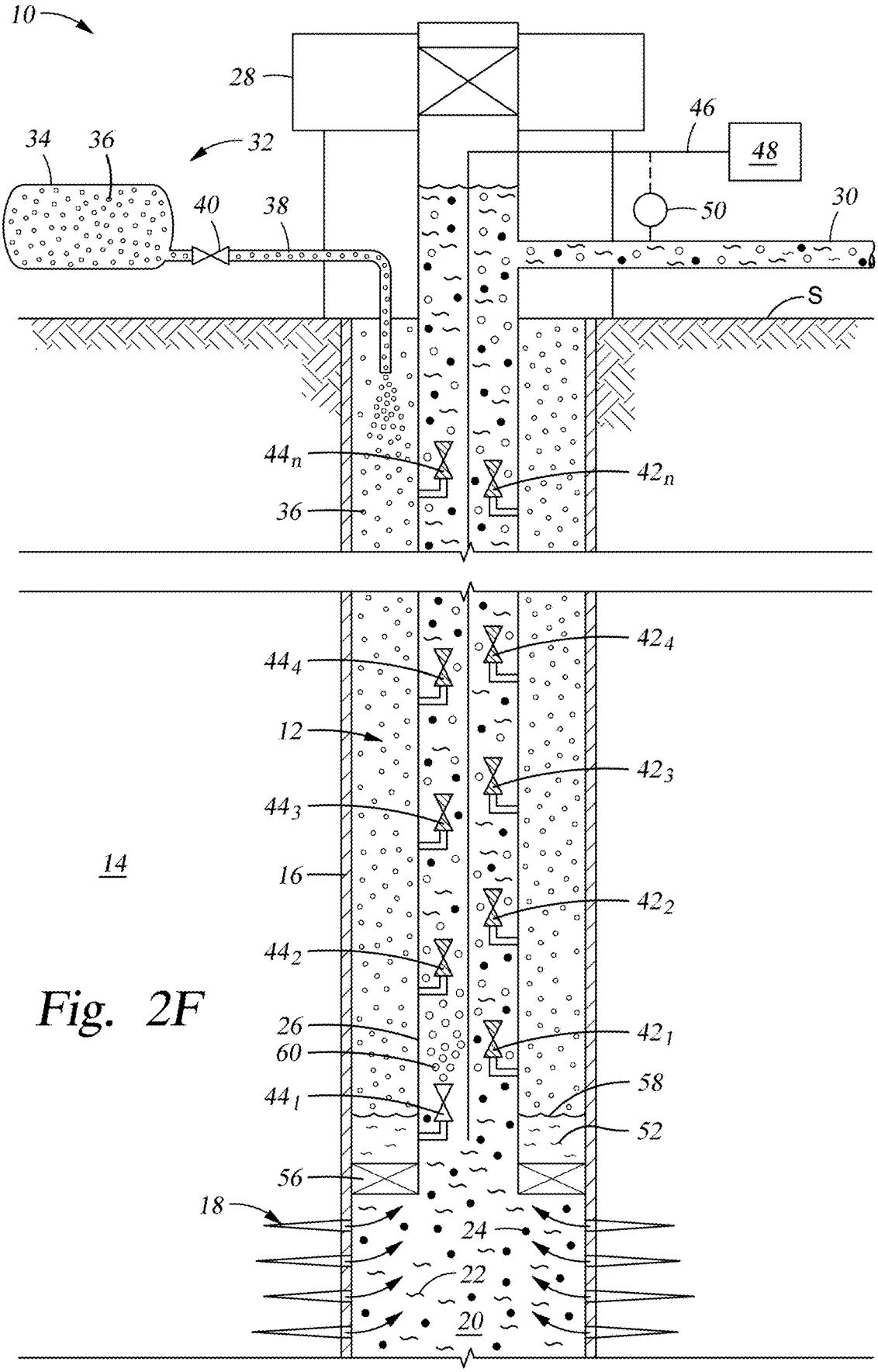

Further in this example, one or more of the anomalies described above are recognized by monitoring signals from the distributed fiberoptic sensor line 46. Example signals include those representing values of pressure and/or temperature within the production tubing 26, and where the recognition is by an operator on surface or logics, such as within controller 48. Based on the signal monitoring, the operator or logics identify a corrective action to remedy the anomaly. An example of a corrective action is to reconfigure one of the shearable lift gas valves $\mathbf{44}_{1\text{-}n}$ from a non-activated to an activated state; which in the example of FIG. 2D shearable lift gas valve $\mathbf{44}_3$ is activated and then put it into an open configuration to replace the malfunctioning lift gas valve $\mathbf{42}_3$ so that bubbles 60 of lift gas 36 are then introduced into the production tubing 26. In a non-limiting example, the operation of shearable lift gas valve $\mathbf{44}_3$ occurs by activating shearable lift gas valve $\mathbf{44}_3$, such as by introducing a pressure into the production tubing 26 that is converted into a force that shears the retaining element within the shearable lift gas valve $\mathbf{44}_3$ so that its operation can be automatic in function the same as or similar to the IPO or PPO valves of the lift gas system 32. By implementation of the shearable lift gas valve $\mathbf{44}_3$, and in the event that other lift gas valves $\mathbf{42}_{1,2}$ or $\mathbf{42}_{4\text{-}n}$ were to become inoperable, one or more of the shearable lift gas valves $\mathbf{44}_{1\text{-}n}$ are initiated into action as described above for replacing functionality of in operating originally installed one of the lift gas valves $\mathbf{42}_{1\text{-}n}$.

illustrated in FIG. 2F is that shearable lift gas valve $\mathbf{44}_1$ has been activated with an application of pressure into production tubing 26 and take over operation of injecting lift gas 36 into the production tubing from now inoperable lift gas valve $\mathbf{42}_1$. Accordingly, the addition of the string of shearable lift gas valves $\mathbf{44}_{1\text{-}n}$ in combination with the distributed fiberoptic sensor line 46, not only provides a redundant functionality of lift gas injection, but also provides the ability to identify depths at which an operation is occurring so that corrective action can be taken at one of the shearable lift gas valves $\mathbf{44}_{1\text{-}n}$ and at an appropriate depth within the wellbore 12.

Figure 3A:
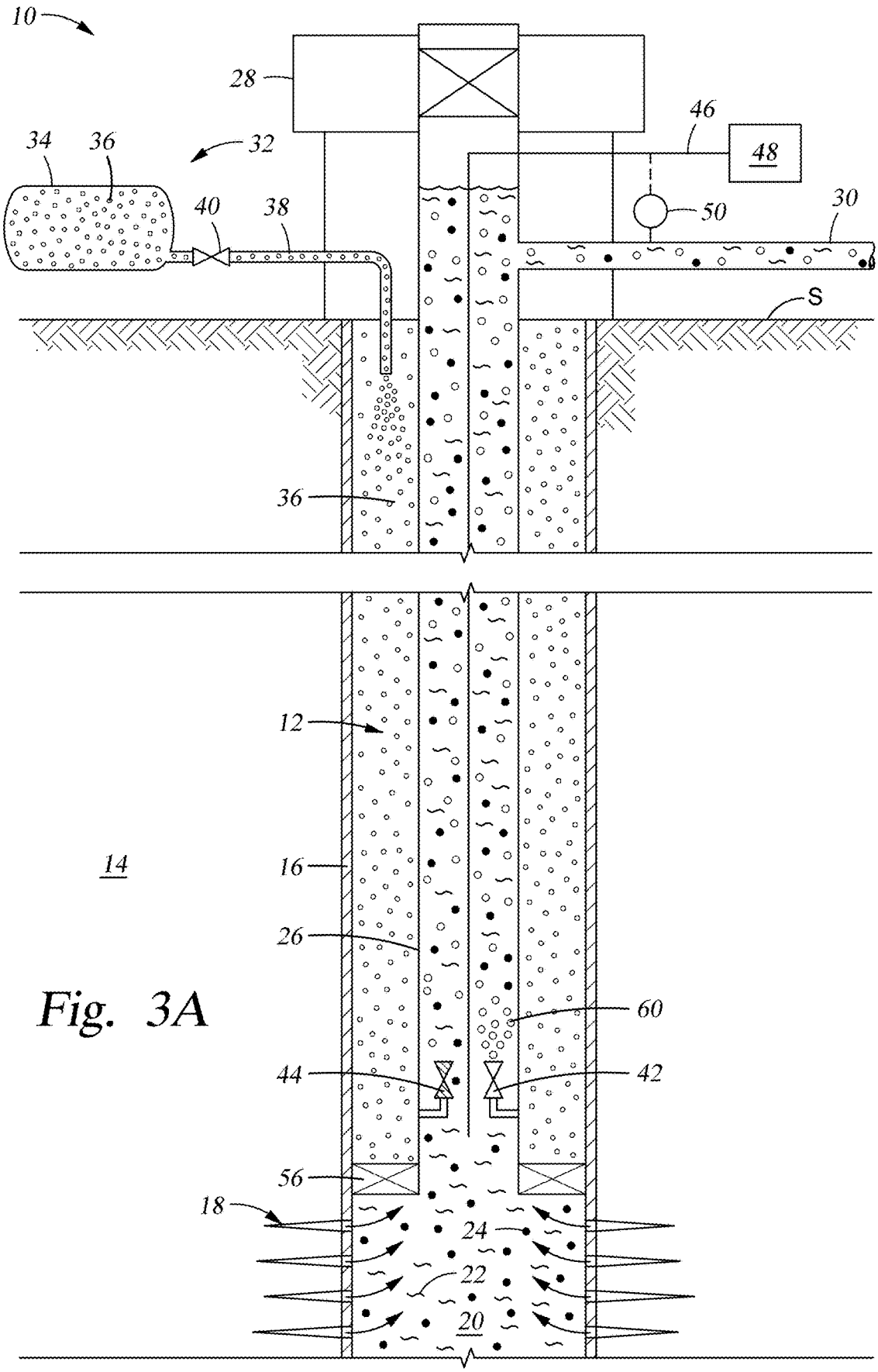
FIGS. 3A and 3B are side sectional views of an alternate embodiment of the gas lift system of FIG. 1 in an example of operation.
Figure 3B:
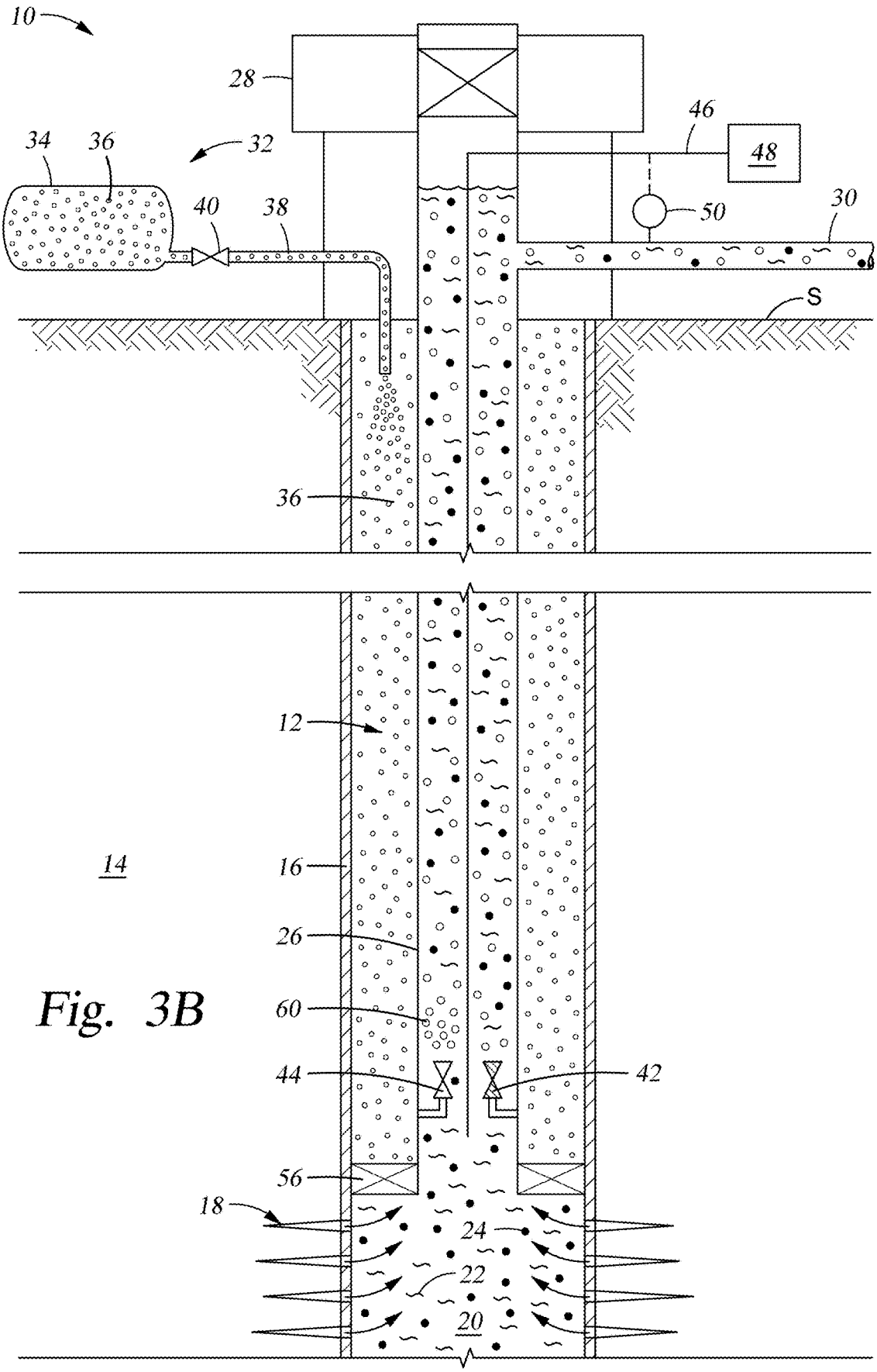

In the examples of FIGS. 3A and 3B, a well system 10 is shown which has a single lift gas valve 42 mounted within production tubing 26 and which provides an injection of lift gas 36 to form bubbles 60 of lift gas within the production tubing 26 to aid in lifting produced fluid 20 to the wellhead assembly 28. A flowrate of fluid 20 and/or liquid 22 being lifted in the production tubing 26 (and lifted within the wellbore 12) is dependent on characteristics of the injection of lift gas 36 through the lift gas valve 42, such as a depth in the wellbore 12 at which the lift gas 36 is being injected, a flowrate of the lift gas injection, pressure of the lift gas 36 being injected (which in examples is dependent on set pressures of a lift gas valve that is injecting the lift gas), and combinations. For the purposes of discussion herein, an optimal or maximum flowrate of fluid 20 and/or liquid 22 potentially being lifted in the production tubing 26 is referred to as optimal production, and values of these operational characteristics of a lift gas valve that achieve optimal production are referred to as designated characteristics (i.e., designated flowrate, designated pressure, and designated depth). It is within the capabilities of one skilled to design and install lift gas valves that have characteristics to have optimal production from a well.

Designated characteristics of a lift gas valve vary when conditions in the wellbore 12 change, such as a reduction in pressure due to hydrocarbon depletion from the surrounding formation 14, so that in examples a lift gas valve or valves, when initially operating, results in optimal production, and after time the production is less than optimal. Optionally, a lift gas valve 42 is improperly designed so that its operational characteristics result in a production of fluid from the wellbore 12 that is initially less than optimal production. In alternatives, less than optimal production is due to a lift gas valve 42 experiencing a mechanical failure, and is in a closed or partially closed configuration so that lift gas injection is at a rate, pressure, and/or depth that is different from a designated rate, pressure, and/or depth.

Similar to the operation described above, monitoring of signals from the distributed fiberoptic line 46 recognizes the anomaly and provides information necessary to identify a corrective action. Further in the example of FIGS. 3A and 3B, shearable lift gas valve 44 is designed to inject lift gas 36 at a flow rate and pressure for optimal artificial lift of the produced fluid 20 up the production tubing 26; alternatively, the design is based on a forecast model of anticipated conditions in the wellbore 12 predicted to occur at a point in time after the well system 10 has been in production. The redundant shearable lift gas valve 44 is brought into operation, as described above, with pressure actuating through the production tubing 26, in situations when the lift gas valve 42 experiences a failure and gas can no longer be injected through the valve 42 into production tubing 26.

Figure 4A:
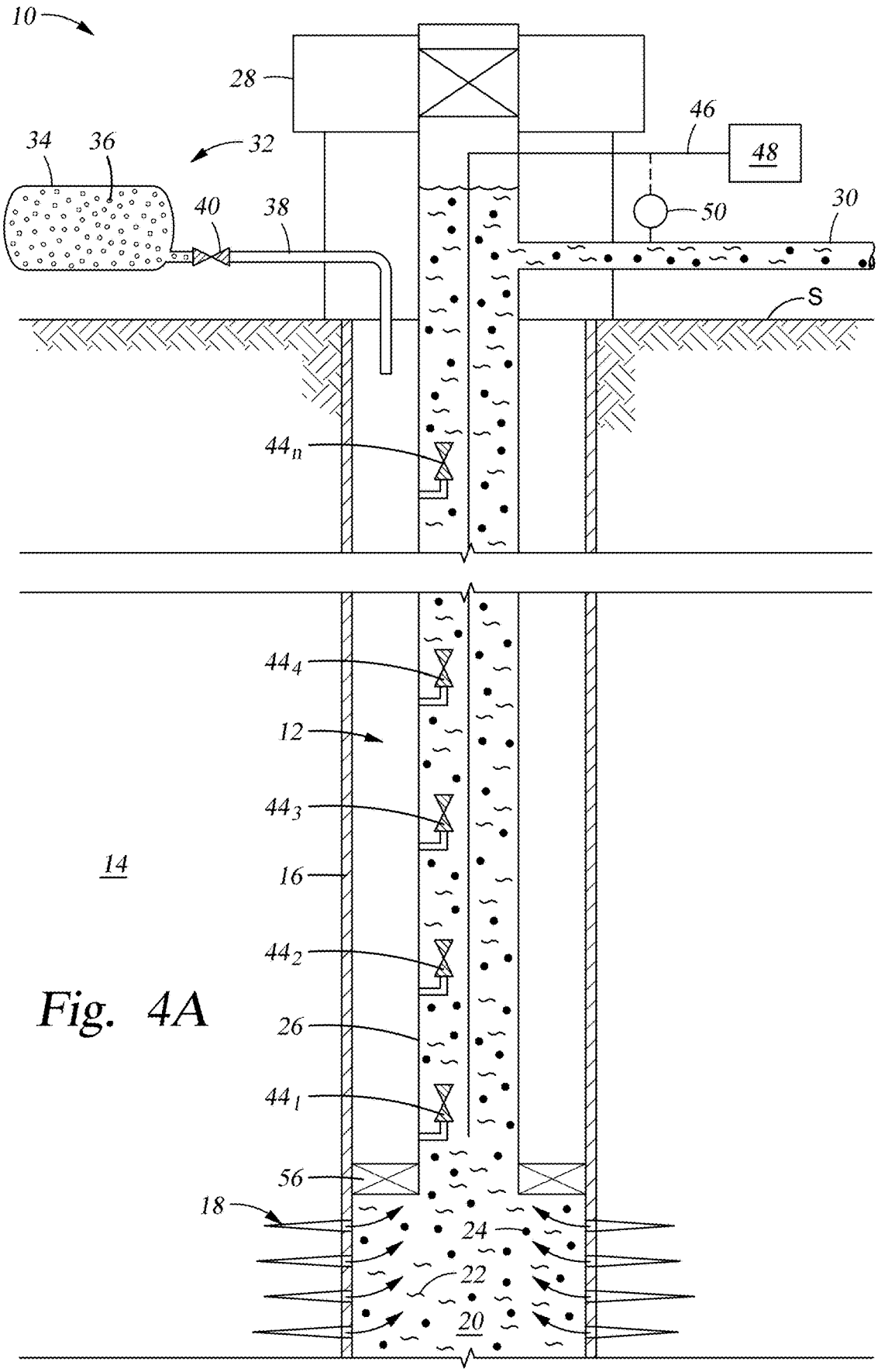
FIGS. 4A-4C are side sectional views of an alternate embodiment of the gas lift system of FIG. 1 in an example of operation.
Figure 4B:
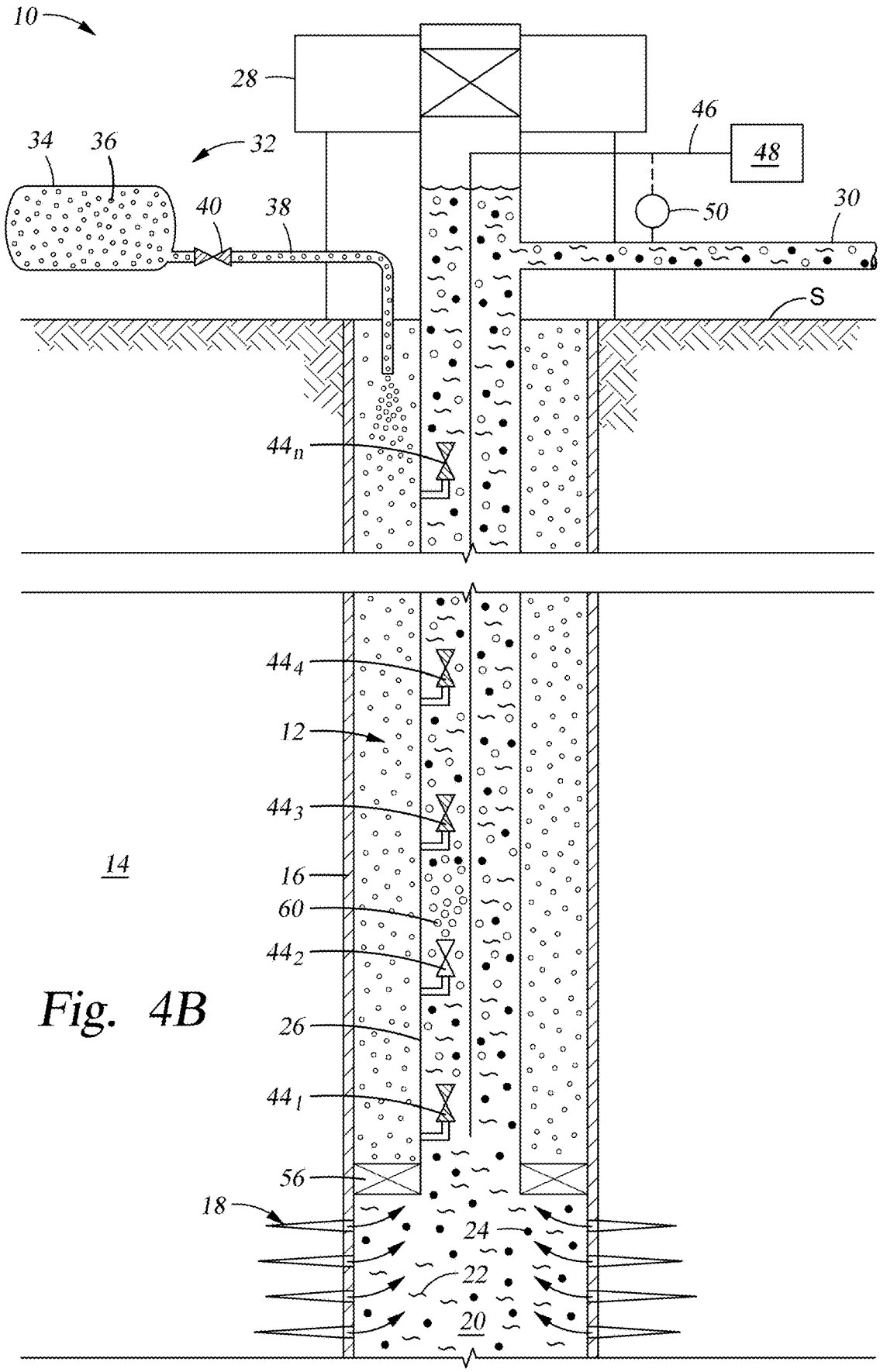
Figure 4C:
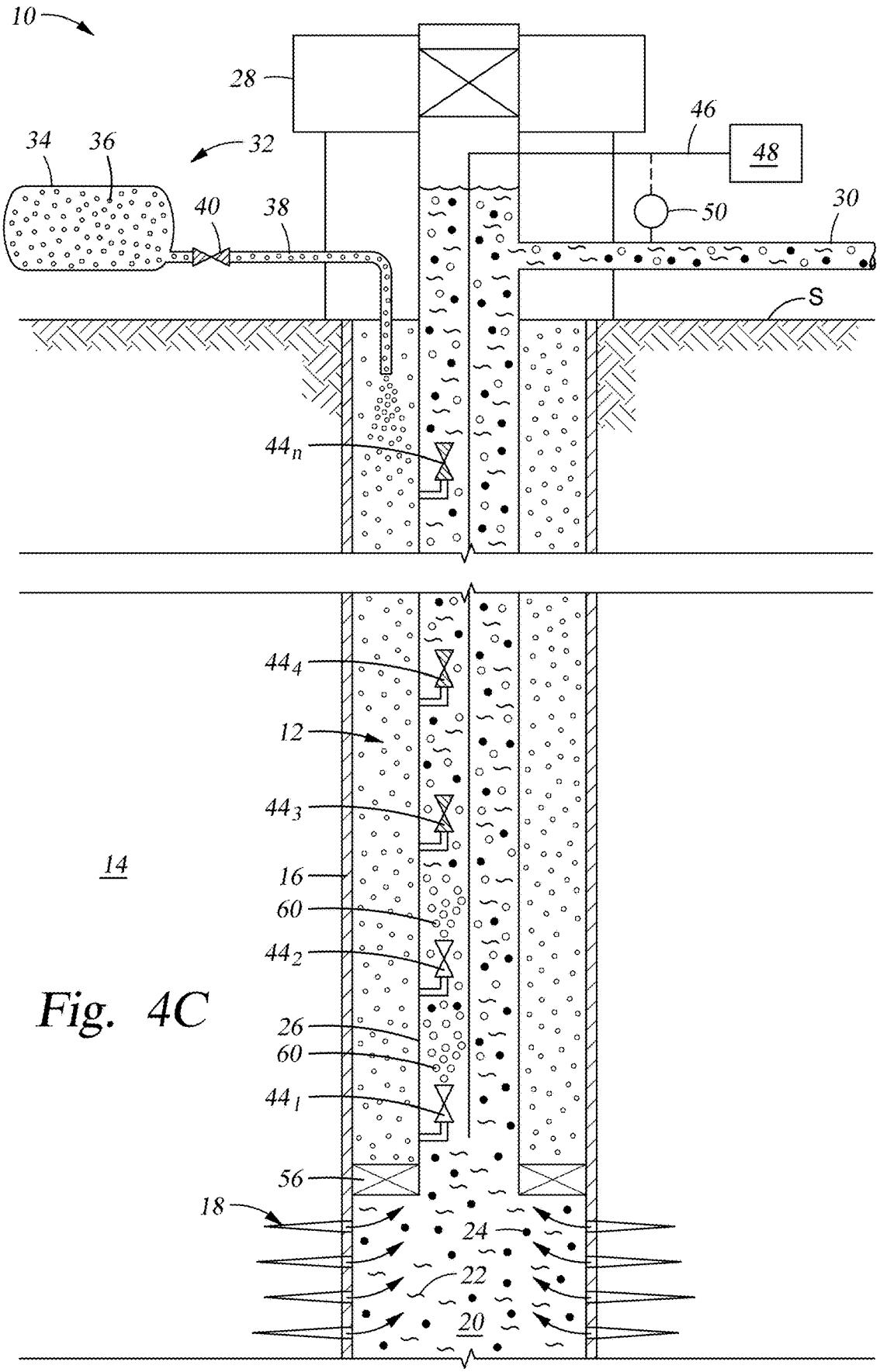

Referring now to FIGS. 4A through 4C, shown is an alternate embodiment of a well system 10 in which a string of shearable lift gas valves $\mathbf{44}_{1\text{-}n}$ is the only potential source for injecting lift gas 36 into the production tubing 26. In this example, when the well system 10 is initially formed pressure within the surrounding formation 14 is adequate to drive the produced fluid 20 within the bottom of wellbore 12 up the production tubing 26 and through the wellhead assembly 28 into the production line 30. Shown in FIGS. 4B and 4C is that over time and with production of hydrocarbons from the formation 14, the pressure in formation 14 becomes reduced so that artificial lift is required to assist with the flow of the produced fluid 20 up the production tubing 26 to wellhead assembly 28 and production line 30. Further in this example, monitoring of the distributed fiberoptic sensor line 46, by personnel on surface S or logics in the controller 48, provides information that assist is needed, and further evaluation of the conditions sensed by the distributed fiber optic sensor line 46 inside of production tubing 26 identifies which of the shearable lift gas valves $\mathbf{44}_{1\text{-}n}$ to initiate operation and then operate. In the example of FIG. 4B, shearable lift gas valve $\mathbf{44}_2$ is shown having been activated and then opened to allow the flow of lift gas 36 into production tubing 26 and form gas bubbles 60 for assisting the flow of the produced fluid 20. Optionally, shown in FIG. 4C is that shearable lift gas valve $\mathbf{44}_1$ and shearable lift gas valve $\mathbf{44}_2$ are now activated and moved into an open configuration to allow injection of lift gas 36 into production tubing 26 and for promoting flow. Embodiments exist in which one, more than one, or all of the shearable lift gas valves $44_{1-n}$ are activated, in alternative embodiments, one, more than one, or all of the activated shearable lift gas valves $44_{1-n}$ are put into a reopen configuration for the injection of lift gas 36.

For the purposes of discussion herein, a designated lift gas injection is defined by a particular amount flow of lift gas 36 being injected into the production tubing 26, at a particular pressure, at a particular flowrate, and through a particular one or more of the shearable lift gas valves $44_{1-n}$, or through a particular one or more of the lift gas valves $42_{1-n}$. An upper end of a column of produced fluid 20 is what is illustrated by liquid level 58.

In alternatives, controller 48 includes a computer, examples of which have a master node processor and memory coupled to a processor to store operating instructions, control information and database records therein. Optionally, controller 48 includes a multicore processor with nodes such as those from Intel Corporation or Advanced Micro Devices (AMD), or an HPC Linux cluster computer, a mainframe computer of any conventional type of suitable processing capacity such as those available from International Business Machines (IBM) of Armonk, N.Y. or other source, a computer of any conventional type of suitable processing capacity, such as a personal computer, laptop computer, or any other suitable processing apparatus. It should thus be understood that multiple commercially available data processing systems and types of computers may be used for this purpose. Controller 48 is optionally accessible to operators or users through a user interface with an option for displaying output data or records of processing results obtained according to the present disclosure with an output graphic user display, which includes components such as a printer and an output display screen capable of providing printed output information or visible displays in the form of graphs, data sheets, graphical images, data plots and the like as output records or images. The user interface optionally includes a suitable user input device or input/output control unit to provide a user access to control or access information and database records and operate the computer. A database of data stored in computer memory is optionally included, such as internal memory, or an external, networked, or non-networked memory in an associated database or in a server. Logics in the controller 48 include executable code stored in non-transitory memory of the computer. The executable code according to the present disclosure is in the form of computer operable instructions the implement some or all elements of the process and cause the data processor to determine subsurface three-phase saturations according to the present disclosure. Examples of executable code include microcode, programs, routines, and symbolic computer operable languages capable of providing a specific set of ordered operations controlling the functioning of the well system 10 and direct its operation. In embodiments, the instructions of executable code are stored in memory of the controller 48, or on computer diskette, magnetic tape, conventional hard disk drive, electronic read-only memory, optical storage device, or other appropriate data storage device having a non-transitory computer readable storage medium stored thereon. Executable code is alternatively contained on a data storage device such as server as a non-transitory computer readable storage medium. Alternatives of controller 48 include a single CPU or a computer cluster, including computer memory and other hardware to make it possible to manipulate data and obtain output data from input data. A cluster is a collection of computers, referred to as nodes, connected via a network. Cluster optionally includes one or two head nodes or master nodes used to synchronize the activities of the other nodes, referred to as processing nodes. The processing nodes each execute the same computer program and work independently on different segments.

In alternatives, sensor technology is expanded by combining the distributed fiber optic sensor with another sensor technology to enhance the accuracy of anomaly detection. Remote activation is considered herein, and in which the shearable lift gas valve is remotely activated using a wireless communication system. Predictive analysis is optionally included with the methods disclosed, and that utilizes machine learning algorithms to predict potential anomalies based on historical data from the distributed fiber optic sensor. In alternatives, safety protocol are initiated in the event of detecting certain predefined critical anomalies. The shearable lift gas valve is optionally made of a material selected for its corrosion resistance and durability under high-pressure conditions. The disclosed methods optionally include other systems, which integrate an output signal from the distributed fiber optic sensor with other wellbore monitoring systems for a comprehensive overview. A feedback loop is optionally included in which the results of the correction are fed back into the system to refine the anomaly detection process. Further considered in the present disclosure is the option of deploying multiple distributed fiber optic sensors at different depths in the wellbore to provide layered monitoring. In alternatives, customizable thresholds are set for anomaly detection based on specific wellbore conditions. Embodiments of the disclosed methods include automated reporting for generating automated reports based on the data from the distributed fiber optic sensor, detailing the anomalies detected, and the corrective actions taken. The energy required for the operation of the shearable lift gas valves is optionally sourced from renewable energy sources deployed near the wellbore. In examples, a maintenance schedule is established for the shearable lift gas valve based on the frequency and nature of anomalies detected. Alternative activation mechanisms are considered for activating the shearable lift gas valves, including but not limited to temperature changes, chemical reactions, or mechanical triggers. Output data from the distributed fiber optic sensor is optionally stored in a cloud-based storage system for long-term analysis and trend prediction. Collaborative operation is included in embodiments, and that includes collaborating with neighboring wellbore operations to share data and insights on anomalies and their corrections.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A method of operating a wellbore comprising:

lifting liquid from within the wellbore using a conventional lift gas valve that is coupled to a production string deployed in the wellbore;

monitoring an output signal from a distributed fiber optic sensor that is deployed in the wellbore, the output signal representing information selected from the group consisting of a pressure in the wellbore sensed by the sensor, a temperature in the well bore sensed by the sensor, and combinations thereof;

based on the step of monitoring, identifying an anomaly that reduces a volume of liquid being lifted to surface by the step of lifting liquid; and correcting the anomaly by, activating a shearable lift gas valve that is coupled to the production string in the wellbore, and urging lift gas through the shearable lift gas valve into the liquid within the wellbore to lift the liquid to surface.

2. The method of claim 1, wherein the anomaly comprises a malfunction of the conventional lift gas valve, and wherein the shearable lift gas valve replaces operation of the conventional lift gas valve to inject lift gas into the liquid being lifted from within the wellbore.

3. The method of claim 1, wherein the anomaly comprises a change in a condition in the wellbore that reduces a rate of liquid being lifted from the wellbore.

4. The method of claim 1, wherein the shearable lift gas valve is included in a string of shearable lift gas valves that are deployed in the wellbore, the method further comprising estimating characteristics of an injection of lift gas in the wellbore for correcting the anomaly, wherein the characteristics of the injection of lift gas comprises parameters selected from the group consisting of a lift gas injection depth, a lift gas injection flowrate, a lift gas injection pressure, and combinations thereof.

5. The method of claim 4, further comprising identifying a particular one or more of the shearable lift gas valves in the string of shearable lift gas valves to be activated based on the estimated characteristics.

6. The method of claim 5, further comprising activating and injecting lift gas through the particular one or more of the shearable lift gas valves.

7. The method of claim 6, wherein the shearable lift gas valves are at different depths, have different set pressures, and different flow rate capacities.

8. The method of claim 4, wherein the step of identifying is based on monitoring the output signal from the distributed fiber optic sensor.

9. The method of claim 4, wherein prior to being installed in the wellbore, depths, set pressures, and flow rate capacities of the shearable lift gas valves are designated based on a forecast of future conditions in the wellbore.

10. The method of claim 1, wherein the anomaly comprises a reduction of pressure in the wellbore, and wherein prior to identifying the anomaly, the liquid is being lifted from within the wellbore by pressure in the wellbore.

11. The method of claim 1, wherein the liquid being lifted from the wellbore is production fluid that has flowed into the wellbore from a formation surrounding the wellbore.

12. The method of claim 1, wherein the liquid being lifted from the wellbore is completion fluid that is being unloaded from the wellbore.

13. A method of operating a wellbore comprising:

lifting liquid from within the wellbore using a conventional lift gas valve that is coupled to a production string deployed in the wellbore, the production string having shearable lift gas valves;

monitoring an output signal from a distributed fiber optic sensor that is deployed in the wellbore, the output signal representing a condition in the wellbore;

based on the step of monitoring, identifying an anomaly that reduces a volume of liquid being lifted to surface by the step of lifting liquid; and correcting the anomaly by, identifying a particular shearable lift gas valve from the string of shearable lift gas valves to be activated to define a particular shearable lift gas valve, activating the particular shearable lift gas valve, and urging lift gas through the particular shearable lift gas valve into the liquid within the wellbore to lift the liquid to surface.

14. The method of claim 13, wherein the step of identifying is based on estimated characteristics of lift gas injection that are selected from the group consisting of a lift gas injection depth, a lift gas injection flowrate, a lift gas injection pressure, and combinations thereof.

15. The method of claim 13, wherein the shearable lift gas valves are at different depths in the wellbore.

* * * * *